United States Patent [19]

Hendricks, Jr.

[11] 4,161,834

[45] Jul. 24, 1979

[54] THEFT PROOF MODULAR SIGN

[76] Inventor: Howard K. Hendricks, Jr., 4030 W. 97th Ter., Overland Park, Kans. 66207

[21] Appl. No.: 821,320

[22] Filed: Aug. 2, 1977

[51] Int. Cl.[2] ..... G09F 15/00

[52] U.S. Cl. ..... 40/606; 40/152.1; 52/506; 248/475 R

[58] Field of Search ..... 40/152, 152.1, 156, 40/584, 606, 605; 248/475; 52/506

[56] References Cited

U.S. PATENT DOCUMENTS

| | | | |
|---|---|---|---|
| 1,599,189 | 9/1926 | Smith | 40/202 |
| 1,778,636 | 10/1930 | Herbert | 40/152.1 |
| 1,809,786 | 6/1931 | Le Jeune | 40/152 |
| 3,597,869 | 8/1971 | Ruyle | 40/152.1 |
| 3,681,867 | 8/1972 | Bilodeau | 40/152.1 |
| 4,006,572 | 2/1977 | Morris | 40/152.1 |

*Primary Examiner*—Louis G. Mancene
*Assistant Examiner*—Wenceslao J. Contreras
*Attorney, Agent, or Firm*—Schmidt, Johnson, Hovey & Williams

[57] ABSTRACT

A tamper-proof wall-mounted modular sign includes a low cost wall-engaging threaded member together with a mating threaded retainer having a concealed anti-rotation device, functioning in combination to securely mount the sign base plate and its protective overlay on the wall in a manner precluding theft or unauthorized alteration of the sign. The cylindrical retainer is significantly larger in diameter than the threaded member and receives the exposed end of the member in enveloping relation thereto such that there is created a desired illusion of solid support for the sign substantially greater than that actually presented by the threaded member. In preferred forms, a threaded spacer having a transverse cross-section identical to that of the retainer is supported on the threaded member between the wall and the base plate to give the sign an aesthetically pleasing appearance of floatation and for further enhancing the illusion of substantial support.

5 Claims, 8 Drawing Figures

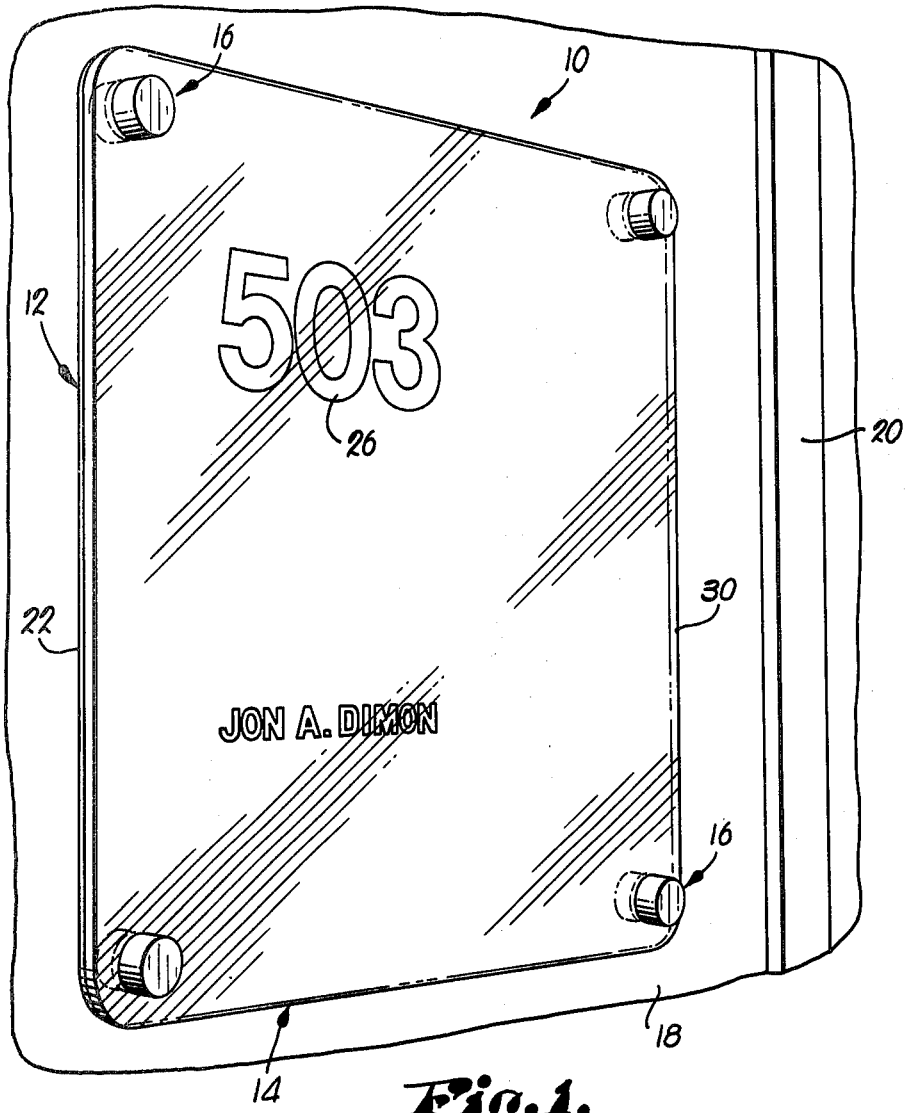
Fig.1.
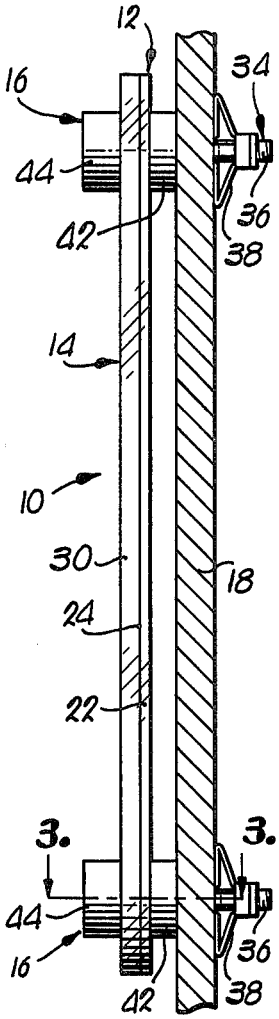
Fig.2.
Fig.4.
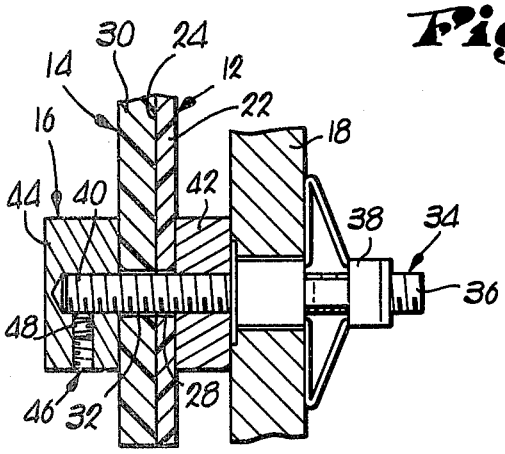
Fig.3.
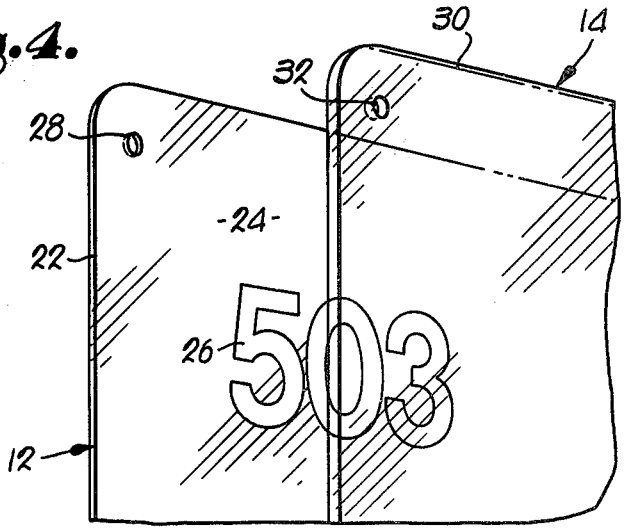

THEFT PROOF MODULAR SIGN

This invention relates to wall-mounted signs in general, and particularly concerns a tamper-proof mounting arrangement for modular signs of the type permitting message alteration as required from time to time.

Of course, signs have been employed since ancient times to convey instructions or directions, identify particular locations, or to provide virtually any other type of information desired. Primarily in the interest of aesthetics, signs through years have become increasingly more ornate and sophisticated in their design. Accordingly, cost of signs have steadily increased such that it is now common practice to employ modular-type signs which permit alteration of the message carried at only a fraction of the cost of procuring a completely new sign.

A problem with modular-type signs is that they are especially vulnerable to theft and vandalism particularly since many of these signs are placed in public areas. In order to function as desired, the modular signs must provide easy access to the message carried such that the latter may be altered when necessary; this very feature of the modular sign, however, permits ready unauthorized access to the message making the latter susceptible to malicious alteration or defacement. Moreover, removable portions of these signs can be easily stolen or destroyed by vandals. In this latter connection, it is not uncommon for thieves to steal an entire sign by simply releasing the mounting structure holding the sign or a supporting wall.

Accordingly, an important object of the present invention is to provide a modular sign of the wall-mounted variety having reduced vulnerability to theft and vandalism.

In accordance with the foregoing object, it is a further important object of my invention to provide a modular sign supported in such a manner as to create an illusion of substantial mounting support in excess of that actually present.

It is yet another important aim of my invention to provide a modular sign with a threaded mounting member of one diameter and a larger diameter, member-receiving retainer adapted to releasably envelop the exposed end of the member, and having a concealed locking device for preventing unauthorized disengagement of the retainer from the member.

In the drawings:

FIG. 1 is a perspective view of a theft-proof modular sign constructed in accordance with the principles of my invention and shown in a typical installation on an upright wall;

FIG. 2 is a top plan view of the sign showing the wall in cross-section;

FIG. 3 is an enlarged, fragmentary cross-sectional view taken along line 3—3 of FIG. 2.

FIG. 4 is an enlarged, fragmentary, exploded view showing the base plate of the sign and its corresponding overlay;

Figure 5:
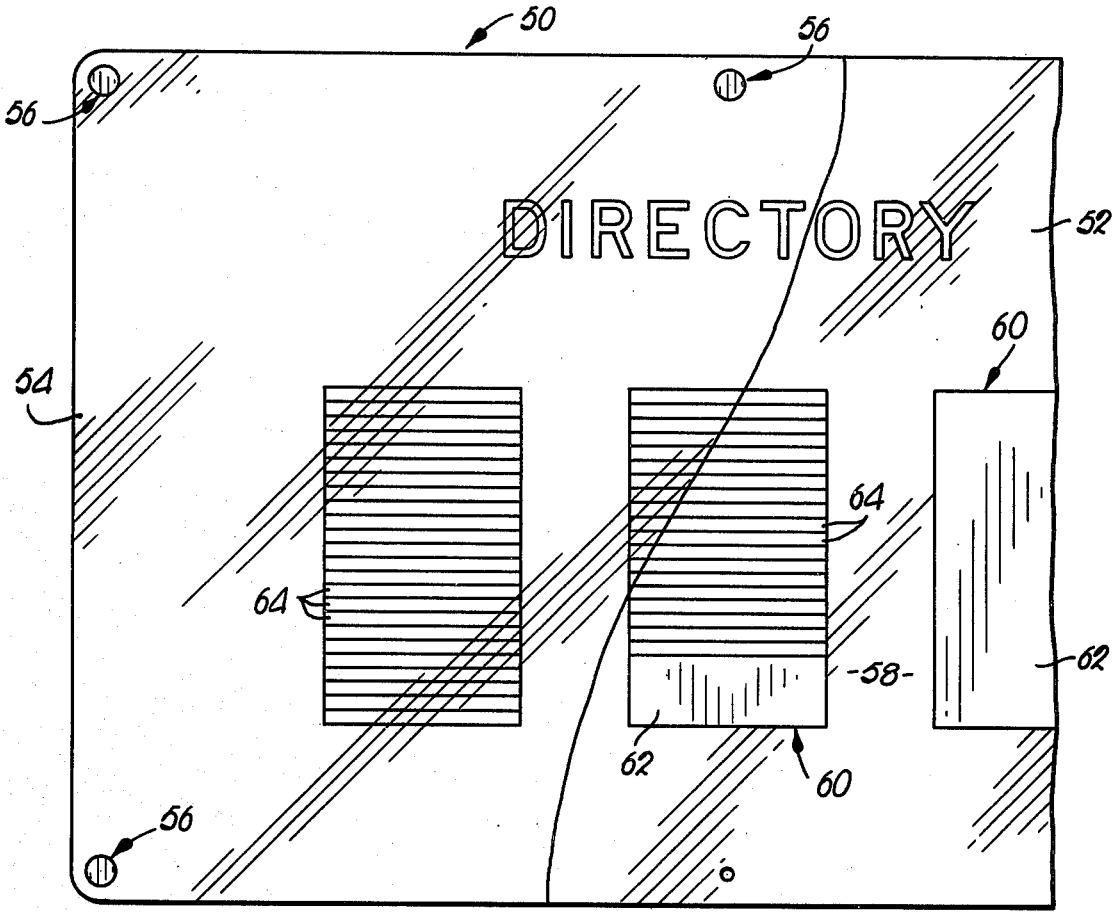
FIG. 5 is a fragmentary, front elevation view of a second embodiment of the invention.

In FIGS. 1 through 4, there is shown a modular sign 10 in a style known in the trade as a tenant sign and including an indicia carrying base plate 12, a transparent overlay plate 14 superimposed over the base plate 12, and four symmetrically arranged mounted assemblies 16 for supporting the plates 12, 14 in an upright display position on a wall 18. Typical application of sign 10 is in placement adjacent a doorway 20 of an office for the purpose of readily identifying the occupant.

The base plate 12 comprises a generally rectangular sheet 22 of bronzed or smokey plexiglass presenting an indicia supporting face 24, and indicia in the form of thin, precut, preferably white vinyl characters 26 supported on the face 24 in a desired arrangement. The corners of sheet 22 are rounded to present a smooth eye-pleasing appearance and an aperture 28 is formed in sheet 22 at each corner thereof for the purpose of engaging the mounting assembly 16 in a manner to be described hereinbelow. The smokey plexiglass sheet 22 renders the base plate 12 translucent though it may be desired to fabricate sheet 22 from opaque plexiglass such that the portion of wall 18 behind the sign 10 is substantially masked.

The overlay plate 14 comprises a sheet 30 of transparent plexiglass having virtually the same rectangular configuration and rounded corners of sheet 22. Additionally, an aperture 32 is provided in each corner of the sheet 30 in such a position as to align with corresponding apertures 28 when plate 14 is in juxtaposition with the base plate 12. It will be appreciated that when the transparent overlay plate 14 is positioned against the base plate 12 as shown for example in FIG. 1, there is created an attractive edge lighting effect which significantly enhances the appearance of the sign 10.

The mounting assemblies 16 are identical in construction, each including an elongate threaded member 34 having one end 36 rigidly secured to the wall 18 by a mating threaded anchor 38 of known construction, and an opposed end 40 projecting outwardly from the wall 18. The threaded members 34 are arranged on the wall 18 to be received within respective aligned apertures 28 and 32 such that the plates 12, 14 are supported on the wall 18 by the member 34 as shown for example in FIGS. 1 and 2. Inasmuch as each member 34 is disposed with its longitudinal axis extending substantially perpendicularly of the wall 18, the plates 12, 14 are carried in an upright, indicia-displaying position generally parallel to the wall 18.

The mounting assemblies 16 are each provided with an annular spacer 42 coaxially supported on a respective threaded member 34 between the wall 18 and the base plate 12. Spacers 42 serve to offset the plates 12, 14 from the wall 18 thereby giving the sign 10 a desired floatation appearance which substantially enhances its beauty.

Each opposed end 40 of the respective members 34 is enclosingly received within a solid, cylindrical retainer 44. As shown for example in FIG. 3, the diameter of the retainer 44 is equal to the outside diameter of the spacer 42 and is considerably larger than the diameter of the threaded member 34. It is to be further noted that when the removable retainer 44 is properly positioned, virtually the entire exposed portion of the threaded member 34 is camouflaged such that there is presented the illusion that the plates 12, 14 are supported by a mount having dimensions of the annular spacer 42 and cylindrical retainer 44 in a manner presenting significantly greater support than that actually provided by the threaded member 34. Thus, the sign 10 is mounted on wall 18 in a relatively inexpensive manner using conventional hardware yet there is presented the appearance to potential thieves and vandals that a much more substantial mounting has been employed.

As a further guard against theft, each retainer 44 is provided with concealed locking means in the form of an anti-rotation device 46 comprising a small set screw 48 threadably coupled with the retainer 44 and disposed for selective biasing against the threaded member 34 once retainer 44 has been properly positioned thereupon. Preferably, the access opening to the set screw 48 is disposed downwardly such that the presence of device 46 is even more concealed.

A second embodiment of the present invention is shown in FIGS. 5–8 and comprises a modular sign 50 in the style commonly referred to as a building directory sign. The sign 50 comprises a base plate 52 similar in construction to the base plate 12, an overlay plate 54 similar in construction to the overlay plate 14, and a plurality of mounting assemblies 56 arranged around the periphery of the plates 52, 54 for supporting the latter on wall 18. In addition to being substantially larger than the base plate 12, base plate 52 carries indicia on its one face 58 in a manner which is somewhat different than the way in which characters 26 are supported on face 24 of plate 12. In this connection, a character-supporting assembly 60 is provided for securing the characters 26 on the face 58 of base plate 52.

Figure 6:
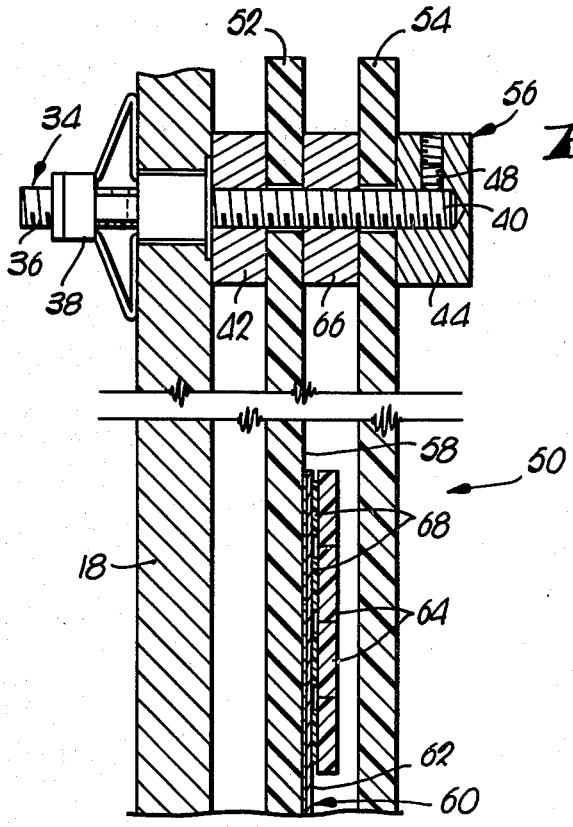
FIG. 6 is an enlarged, fragmentary, vertical cross-sectional view of the sign shown in FIG. 5.
Figure 7:
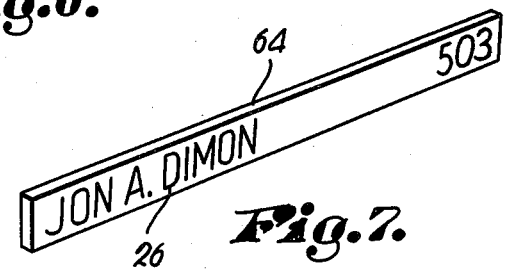
FIG. 7 is an enlarged, perspective view of a marker bar forming a part of the invention shown in FIG. 5.
Figure 8:
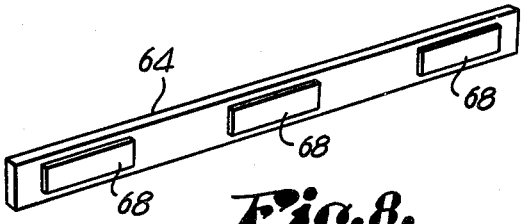
FIG. 8 is an enlarged, perspective view showing the back side of the bar illustrated in FIG. 7.

As shown in FIG. 6, the assembly 60 includes a thin ferrous metal sheet 62 adhesively bonded to the face 58 of plate 52 and a plurality of character-supporting marker bars 64 removably attached to the sheet 62 by magnets 68 mounted on the back side of the bars 64. As shown in FIG. 7, the characters 26 are carried on the front face of bars 64 such that the latter may be arranged on the metal sheet 62 to convey virtually any desired message.

The mounting assemblies 56 are virtually identical to the assemblies 16 with the exception that there is provided for each assembly 56 an annular spacer block 66 identical in construction to the spacer 42; each block 66 being coaxially disposed on a respective threaded member 34 between plates 52 and 54. In this manner, the overlay plate 54 is slightly offset from the base plate 52 for accomodating the additional dimension presented by the character-supporting assembly 60.

In order to augment the eye-pleasing appearance presented by the signs 10 and 50, the annular spacer 42, cylindrical retainer 44, and spacer block 66 all are preferably provided with similar decorative metal finishes. Examples of finishes which have proved satisfactory in actual practice include chrome, polished brass, and oxidized brass which gives the appearance of bronze.

In use, the sign 10 is simply mounted on the wall 18 in an indicia-displaying position as described hereinabove. Of course, after the retainers 44 are screwed onto the fastener 34, it is desirable to torque the set screws 48 against respective threaded members 34 to preclude unauthorized removal of the sign 10.

When it is desired to change the message conveyed by the sign 10, it is but a simple matter to gain access to the characters 26 carried on the base plate 12 by first releasing the anti-rotation devices 46 and then unscrewing the retainers 44 to permit removal of the overlay sheet 14 from its position protectively covering the characters 26. Characters 26 can then be rearranged, removed, or additional characters 26 added to create the desired new message, after which the modular sign 10 is reassembled by reversing the above described procedure.

In the case of the building directory sign 50, information conveyed may be changed by simply rearranging the bars 64 or adding additional bars. This is particularly advantageous in office building directory signs where the list of tenants constantly changes requiring continual rearrangement of the directory information. Of course, access to the character-supporting assembly 60 is made in a manner similar to that described above for the modular sign 10.

From the foregoing, it can be seen that the present invention offers significant advantages in rendering a modular sign virtually vandal proof. The unique arrangement of the mounting assemblies 16 and 56 provides ready authorized access to the informational portion of the signs 10, 50 yet precludes unauthorized access to this area by vandals or others bent on property destruction. Moreover, the mounting assemblies 16, 56 provide a convenient, economically feasible means for securing the signs 10, 50 to a wall or the like while at the same time creating an illusion that the signs 10, 50 are secured to the wall in a highly substantial manner thereby tending to discourage thieves from attempting to remove them.

All of the above benefits are realized without altering the pleasing appearance presented by edge-lighted signs, Moreover, the present invention requires only minor modification to the mounting substrate such the removal, replacement or addition of signs is easily accomplished.

I claim:

1. A theft-proof wall-mounted sign including:

a rigid base plate having indicia superimposed on one face thereof;

a transparent overlay plate in juxtaposition with said base plate and protectively covering said indicia;

at least one elongate threaded member having one end rigidly secured to said wall and an opposed end projecting outwardly therefrom, said member engaging said plates intermediate said ends to mount the latter in a substantially upright position on said wall with said indicia facing outwardly therefrom;

a solid retainer threadably coupled with said opposed end and having a side wall portion and an end section disposed in enveloping relation to said opposed end for holding said plates juxtaposed and maintaining the latter in engagement with said member, said retainer being provided with an inner flat surface in complemental abutting relationship to said overlay plate, said retainer having a transverse cross-sectional area greater than that of said member to create an illusionary appearance of support for said sign which is more substantial than that actually presented by the threaded member;

a spacer supported on said threaded member between the wall and said base sheet, said spacer having opposed flat faces, one of which abuts the base sheet and the other being adapted to abut the wall, said spacer being provided with a transverse cross-section identical to that of said retainer whereby the illusionary appearance of increased support is further enhanced; and set screw locking means extending transversely through the side wall of the retainer and releasably engaging said member for preventing unauthorized rotation and thereby removal of the retainer from the member whereby the sign is rendered substantially tamper-proof.

2. The invention of claim 1, said spacer and said retainer being cylindrical, presenting circular transverse cross-sections.

3. The invention of claim 1; said indicia comprising a plurality of opaque relatively thin characters, said overlay plate being disposed against said one face.

4. The invention of claim 1; said indicia including a thin ferrous metal sheet carried on said face and a plurality of marker bars magnetically mounted on said sheet.

5. The invention of claim 4; and a spacing block on said threaded member intermediate said plates of the same transverse cross-section as said spacer and the retainer and provided with opposed flat surfaces engaging the proximal surfaces of the plates.

* * * * *